United States Patent [19]

Burt

[11] 4,418,338

[45] Nov. 29, 1983

[54] OPTICAL FIBRE U.V. AND/OR I.R. LINE FIRE DETECTOR

[76] Inventor: Dennis W. Burt, The Bungalow, Woodhouse La., Loosegate, Nr. Spalding, Lincolnshire, England

[21] Appl. No.: 208,558

[22] Filed: Nov. 20, 1980

[51] Int. Cl.[3] ..... G08B 17/12

[52] U.S. Cl. ..... 340/578; 250/227; 340/515; 340/600

[58] Field of Search ..... 340/578, 600, 596, 515; 250/227

[56] References Cited

U.S. PATENT DOCUMENTS 3,444,378 5/1969 Cibula et al. ..... 250/227

4,264,211 4/1981 Biggs ..... 250/227

FOREIGN PATENT DOCUMENTS 54-149497 11/1979 Japan ..... 340/578

723635 3/1980 U.S.S.R. ..... 340/600

*Primary Examiner*—Glen R. Swann, III

*Attorney, Agent, or Firm*—Basile, Weintraub & Hanlon

[57] ABSTRACT

A fire and/or heat detection system comprises an optical fibre which is either unsheathed or sheathed in a transparent material such that U.V. or I.R. radiation in the vicinity of the fibre passes through the skin into the body of the fibre. Means are connected to the ends of the fibre to measure these radiations.

12 Claims, 3 Drawing Figures

OPTICAL FIBRE U.V. AND/OR I.R. LINE FIRE DETECTOR

BACKGROUND OF THE INVENTION

1. Field of the Invention

This invention relates to the use of clad/sheathed or unclad/unsheathed optical fibre(s) with ultra violet (U.V.) and/or infra-red (I.R.) radiation sensors to form line or spot fire and/or heat detectors.

There are three aspects of the invention. In the first, the fibre(s) is left unclad/unsheathed, or sheathed with a transparent material, such that ultra violet radiation in the vicinity of the fibre(s) passes through the fibre(s) skin into its body. The ultra violet radiation once inside the body of the fibre is transmitted to the ends of the fibre(s) by the natural physical characteristics of optical fibre(s). Use is made of this natural characteristic to extend the viewing of special or standard commercially available U.V. Fire Detectors, to overcome certain defects inherent with this type of detector.

2. Description of the Prior Art

Commercially, Fire Detectors tuned to U.V. radiation are installed in fire risk areas to monitor for flames created by a fire in those areas. The flames radiate U.V. radiation which is collected by the Detector viewing window. All such detectors suffer a common fault of only being able to view in a straight line and this line of vision must be unobstructed. This places limitations upon the usage of fire detectors of this kind and limitations upon the customer when they are used. In the invention now being described these defects are overcome by using an optical fibre to extend, shape or bend the viewing angle in order to extend the radiation collecting ability of the U.V. Flame Detector.

BRIEF DESCRIPTION OF THE DRAWING

The invention will now be described with reference to the following drawing in which.

DESCRIPTION OF THE PREFERRED EMBODIMENTS

The fibre, or fibres, is installed in and around the fire risk area such that U.V. transmissions radiating from any flame, or flames (FIG. 2A), in the area are absorbed by the fibre. This absorbed U.V. radiation L appears at the end of the fibre A which is connected to a special or commercial U.V. sensor, such a sensor normally being tuned to the U.V. radiation frequency of flames.

The sensor and the complimentary equipment are conventional instrumentation already commercially available, and are mentioned only for the purpose of illustrating method of collecting or picking-up the U.V. radiation.

In the second aspect of the invention, the fibre is left unclad/unsheathed, or sheathed with a transparent material, such that infra-red radiation in the vicinity of the fibre passes through the fibre skin into its body. The infra-red radiation once inside the body of the fibre is transmitted to the ends of the fibre by the natural physical characteristics of optical fibres.

Commercial temperature monitors or fire detectors based upon infra-red (I.R.) sensing are in common use, but virtually all suffer the same operating limitation of having to view the monitored heat source in a straight unobstructed line. In the invention now being described this limitation is overcome by attaching an optical fibre to the infra-red sensor to extend, bend or shape its viewing ability.

Figure 2:
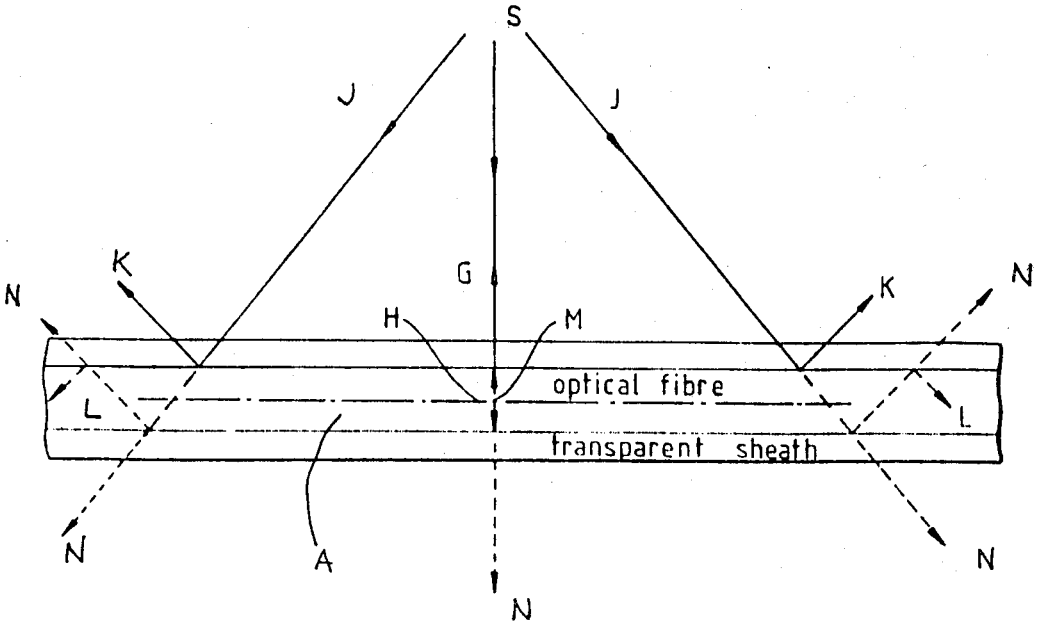
FIG. 2 is a diagramatic representation of the operation of the optical fibre in accordance with the teachings of the present invention.

The fibre(s) is installed in and around the area to be monitored such that any fibre or heat I.R. radiation B, FIG. 2, is absorbed by the fibre(s) through its outer surfaces or skin. This absorbed I.R. radiation D is transmitted through the fibre(s) by the natural characteristics of optical fibres to appear at the end of the fibre(s), which is connected to I.R. sensitive viewing apparatus or commercial infra-red detectors, the resulting instrumentation values being used for temperature or fire analogues or alarms/control.

Figure 3:
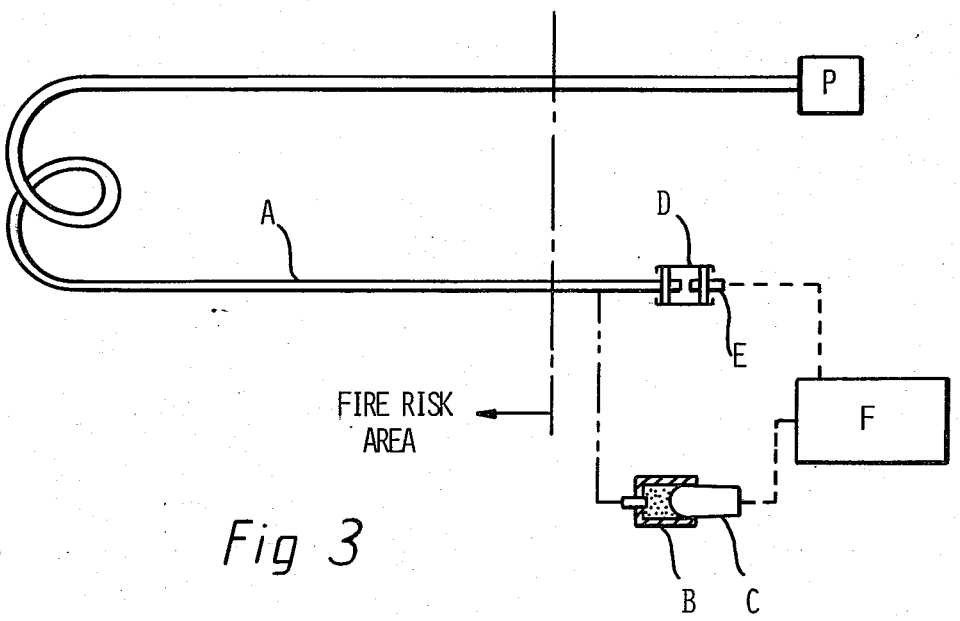
FIG. 3 is a diagramatical view of another embodiment of the optical fibre line fire detector of the present invention.

In both the U.V. and I.R. aspects previously described, collection of absorbed radiation is either at one fibre end with the other end blanked or used to inject a test source P, FIG. 3, to the detector, or the same absorbed is collected at both ends. In a third aspect now to be described, a slightly more complex combination of both U.V. and I.R. collection is envisaged. In this third aspect the fibre is left unclad/unsheathed, or sheathed with a material transparent to U.V. and I.R. radiation such that U.V. or I.R. radiation in the vicinity of the fibre A, FIG. 2, passes through the fibre skin into its body. This radiation once inside the body of the fibre is transmitted to the ends of the fibre by the natural characteristics of optical fibres. The fibre is installed around the area to be monitored for fire and/or heat such that U.V. and/or I.R. radiations in the area are absorbed or collected by the fibre for transmission to the fibre ends. Connected to one end of the fibre is a special or commercial detector B and C, FIG. 1, tuned to U.V. radiation only. Connected to the other end of the fibre A is a special or commercial detector D and E, FIG. 1, tuned to I.R. radiation only. The electrical signals from these detectors, proportional to the radiation received by them, is processed by suitable electronics FIG. 1, not the subject of this invention, to provide the necessary indications for fire alarm/control and/or heat monitors/control.

Figure 1:
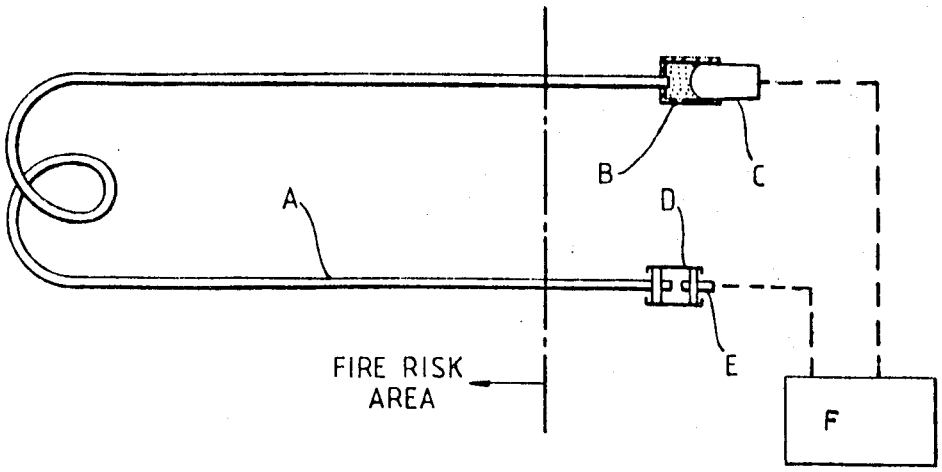
FIG. 1 is a diagramatic view of the optical fibre line fire detector of the present invention.

FIG. 2 represents, in a diagrammatic manner, the operation of an optical fibre A in the fire detection system of FIG. 1. A radiation source S, such as a fire, emits radiation in all directions. Some of the radiation is directed towards the optical fibre A which has a longitudinal axis H and is coated by a transparent sheath as shown. Some of the radiation travels along path G where it meets the optical fibre A at right angles. Other radiation pathways J result in the radiation meeting the optical fibre A obliquely. The fate of the radiation which meets the optical fibre A depends, as is well known from physical optics, upon its angle of incidence. Thus radiation travelling along pathway G enters the optical fibre A and can experience multiple reflections M between opposite points on the sidewall of the optical fibre A. This results in some direct transmission of radiation out of the fibre at N, and also in some radiation returning along pathway G towards the source S. When the radiation meets the optical fibre A along an oblique pathway as at J, the fate of the radiation is different. Some radiation enters the transparent sheath and is reflected, as at K, from the interface between the transparent sheath and the optical fibre A. It should be noted that, for ease of illustration, the radiation pathways within the transparent sheath and optical fibre A, as shown in FIG. 2 ignore refraction effects.

A portion of the radiation travelling along pathway J crosses the interface between the transparent sheath and the optical fibre A and moves towards the fibre axis H. A portion of this radiation passes through the opposite interface between the fibre and the transparent sheath and is subsequently lost as at N. The remainder of this portion of radiation suffers internal reflection within the optical fibre A, and repeated internal reflections result in a proportion of the radiation being directed as at L along the length of the optical fibre A. At each reflection, a small proportion of the radiation is lost by transmission through the fibre/sheath interface; for convenience, all such losses are depicted in FIG. 2 by reference character N. Since radiation from the source S impinges upon a substantial surface area of the optical fibre A, a significant proportion of radiation reaches the detectors B, C and D, E as shown in FIG. 1 where electrical signals are generated which are proportional to the radiation received.

What I claim is:

1. A fire detection system comprising an optical fibre having first and second ends and an exterior surface extending between the first and second ends and means connected to the optical fibre for detecting at least one of U.V. and I.R. radiation, said radiation being absorbed through any point of the entire exterior surface of the fibre.

2. The detection system as in claim 1 wherein the fibre is unsheathed.

3. The detection system as in claim 1 wherein the fibre is sheathed in material transparent to U.V. radiation.

4. The detection system as in claim 1 wherein the fibre is sheathed in a material transparent to I.R. radiation.

5. The detection system as in claim 1 wherein the fibre is sheathed in a material transparent to U.V. and I.R. radiation.

6. The detection system as in claim 1, 2, 3 or 5 wherein U.V. radiation detectors are connected to at least one end of the fibre to detect and measure U.V. radiations absorbed by the fibre.

7. The detection system as in claim 1, 2, 3 or 5 wherein a U.V. radiation detector is connected to one end of the fibre and a test source of U.V. radiation is connected to the other end of the fibre.

8. The detection system as in claim 1, 2, 4 or 5 wherein I.R. radiation detectors are connected to at least one end of the fibre to detect and measure I.R. radiations absorbed by the fibre.

9. The detection system as in claim 1, 2, 4 or 5 wherein an I.R. radiation detector is connected to one end of the fibre and a test source of I.R. radiation is connected to the other end of the fibre.

10. The detection system as in claim 1, 2, 3, 4 or 5 wherein a U.V. radiation detector is connected to one end of the fibre and an I.R. radiation detector is connected to the other end of the fibre to detect and measure both U.V. and I.R. radiations absorbed by the fibre.

11. The detection system as in claim 1, 2 or 5 wherein the fibre is installed in and around a predetermined area to be monitored for U.V. and I.R. radiation.

12. The detection system as in claim 1, 2, 3, 4 or 5 wherein:

a U.V. radiation detector is connected to one end of the fibre;

an I.R. radiation detector is connected to the other end of the fibre;

the fibre is installed in and around a predetermined area to monitor U.V. and I.R. radiation; and further including means, responsive to signals from the U.V. and I.R. detectors which are proportional to the detected U.V. and I.R. radiation, for indicating the occurrence of a fire in the predetermined area.

* * * * *